US009772595B2

(12) United States Patent
Togawa

(10) Patent No.: US 9,772,595 B2
(45) Date of Patent: Sep. 26, 2017

(54) IMAGE FORMING SYSTEM, IMAGE FORMING DEVICE, POST-PROCESSING DEVICE, AND NON-TRANSITORY COMPUTER READABLE RECORDING MEDIUM STORED WITH CONVEYANCE ABNORMITY DETECTION PROGRAM

(71) Applicant: Konica Minolta, Inc., Tokyo (JP)

(72) Inventor: Takanori Togawa, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/959,895

(22) Filed: Dec. 4, 2015

(65) Prior Publication Data

US 2016/0161896 A1 Jun. 9, 2016

(30) Foreign Application Priority Data

Dec. 5, 2014 (JP) ..... 2014-247289

(51) Int. Cl.
*G03G 15/00* (2006.01)

(52) U.S. Cl.
CPC ... *G03G 15/70* (2013.01); *G03G 2215/00552* (2013.01)

(58) Field of Classification Search
CPC ..... G03G 2215/00552; G03G 15/70
See application file for complete search history.

(56) References Cited

U.S. PATENT DOCUMENTS 5,034,771 A * 7/1991 Makita ..... 399/21
5,479,240 A * 12/1995 Lee et al. ..... 399/21
2011/0101600 A1* 5/2011 Chihara ..... B65H 1/14 271/152

FOREIGN PATENT DOCUMENTS

JP H02-176766 A 7/1990
JP H07-301963 A 11/1995
JP 2007-106559 A 4/2007

OTHER PUBLICATIONS

Office Action issued in corresponding Japanese Application No. 2014-247289 dated Jan. 31, 2017, and English translation thereof (6 pages).

* cited by examiner

*Primary Examiner* — Matthew G Marini
(74) *Attorney, Agent, or Firm* — Osha Liang LLP

(57) ABSTRACT

An image forming system detects a first conveyance abnormality of a recording material when a time taken for the recording material conveyed along a conveyance path in the image forming system to pass a predetermined position exceeds a first threshold value, temporarily stops the conveyance of the recording material when the first conveyance abnormality is detected and changes the first threshold value to a second threshold value larger than the first threshold value when the conveyance of the recording material is temporarily stopped, and detects a second conveyance abnormality based on the second threshold when a re-conveyance is made to eject the recording material remaining in the conveyance path.

14 Claims, 8 Drawing Sheets

FIG. 9

| Productivity | Maximum overlapping sheet number |
|---|---|
| ~40ppm | 1 sheet |
| 41~60ppm | 2 sheets |
| 61~120ppm | 3 sheets |

IMAGE FORMING SYSTEM, IMAGE FORMING DEVICE, POST-PROCESSING DEVICE, AND NON-TRANSITORY COMPUTER READABLE RECORDING MEDIUM STORED WITH CONVEYANCE ABNORMITY DETECTION PROGRAM

CROSS-REFERENCE TO RELATED APPLICATION

This application is based on Japanese Patent Application No. 2014-247289 filed on Dec. 5, 2014, the contents of which are incorporated herein by reference.

BACKGROUND

Technical Field

The present invention relates to an image forming system, an image forming device, a post-processing device, and a non-transitory computer readable recording medium stored with a conveyance abnormality detection program.

Background Art

In the image forming system, a technique referred to as automatic purging is known in which when a conveyance abnormality such as a jam or the like occurs in a paper conveyance path, the conveyance of the paper is stopped, and after the paper which has caused the jam is removed, the paper remaining in the conveyance path is automatically ejected. By virtue of the automatic purging being performed, it is possible to decrease a load for the user to process the jam such as operation for removing the paper remaining.

However, due to the high functionality of the image forming system and the extension of the conveyance path, a jam can occur again when the paper is conveyed by automatic purging.

A technique is known for detecting a jam while the paper is being conveyed by automatic purging (for example, Japanese Patent Publication Laid-open No. 1995-301963).

As the method for detecting a jam, a method is known such that the time from when one sensor provided on the conveyance path detects the leading end of the paper to when it detects the trailing end of the paper is calculated as the paper passing time, and when the paper passing time exceeds a predetermined threshold value, it is detected as a jam.

However, in the technique described in the above patent document, a jam is detected on the assumption that the papers are conveyed sheet by sheet during automatic purging. Therefore, no attention is paid to a case where the papers are conveyed while overlapping each other during automatic purging.

For example, upon occurrence of a jam, the respective devices configuring the image forming system notify the occurrence of the jam, an instruction to stop the paper conveyance or the like to each other via communication. Due to a time lag associated with this communication or the like, the timing that the paper conveyance is stopped differs from device to device. Thus, it sometimes happens that the preceding downstream-side paper is caught up by the succeeding upstream-side paper so that the papers are stopped in a state of partially overlapping each other.

In this manner, when the papers are conveyed in a state of overlapping each other by automatic purging without changing the state, there is no interval between the papers so that the time from when one sensor detects the leading end of a downstream-side paper to when it detects the trailing end of an upstream-side paper is detected as the paper passing time.

For example, when a jam is detected based on the length of the paper passing time, the paper passing time is increased because of the papers being conveyed while overlapping each other so that there is a possibility that despite the papers being conveyed, it is erroneously determined that a jam has occurred.

SUMMARY

Accordingly, one or more embodiments of the present invention provide an image forming system, which is configured to properly perform automatic purging even when papers overlap each other, an image forming device, a post-processing device, and a non-transitory computer readable recording medium stored with a conveyance abnormality detecting program.

According to one or more embodiments of the present invention, an image forming system includes an image forming device that forms an image on a recording material, and a post-processing device that post-processes the recording material. The image forming system further includes a detector that detects a first conveyance abnormality of the recording material when a time taken for the recording material conveyed along a conveyance path in the image forming system to pass a predetermined position exceeds a first threshold value, and a controller that temporarily stops the conveyance of the recording material when the first conveyance abnormality is detected by the detector, changes the first threshold value to a second threshold value larger than the first threshold value when the conveyance of the recording material is temporarily stopped, and causes the detector to detect a second conveyance abnormality based on the second threshold when a re-conveyance is made to eject the recording material remaining in the conveyance path.

According to one or more embodiments of the present invention, the controller may determine the second threshold value based on the size of the recording material.

According to one or more embodiments of the present invention, the controller may determine the second threshold value based on the cycle time to convey the recording material.

Aspects, features, and characteristics of one or more embodiments of the present invention other than those set forth above will become apparent from the description given herein below with reference to one or more embodiments illustrated in the accompanying drawings.

BRIEF DESCRIPTION OF THE DRAWINGS

FIG. 9 is a view illustrating a configuration example of the relationship in correspondence between a set value for the productivity and the maximum overlapping sheet number.

DETAILED DESCRIPTION

Figure 1:
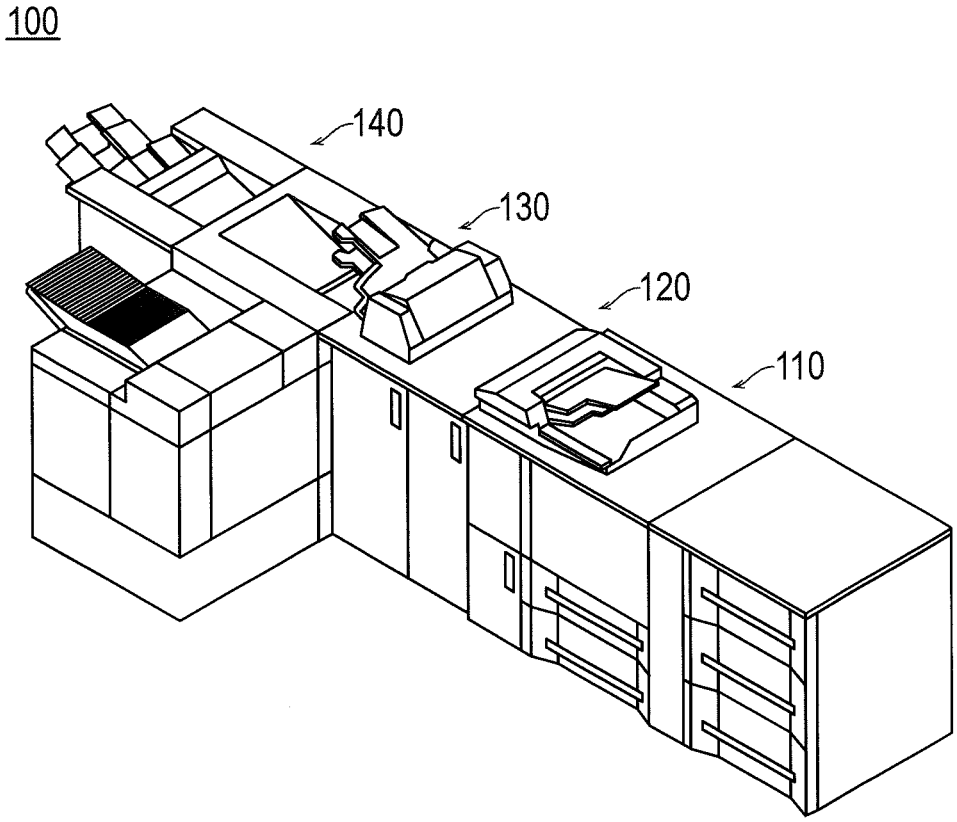
FIG. 1 is a perspective view illustrating an external appearance of an image forming system according to one or more embodiments of the present invention.

With reference to the accompanying drawings, one or more embodiments of the present invention will be described below. In the description of the drawings, the same elements are denoted by the same reference numerals, and overlapping description is omitted. In addition, in some case, dimensional ratios in the drawings are exaggerated and different from actual ratios for convenience of the description.

Figure 2:
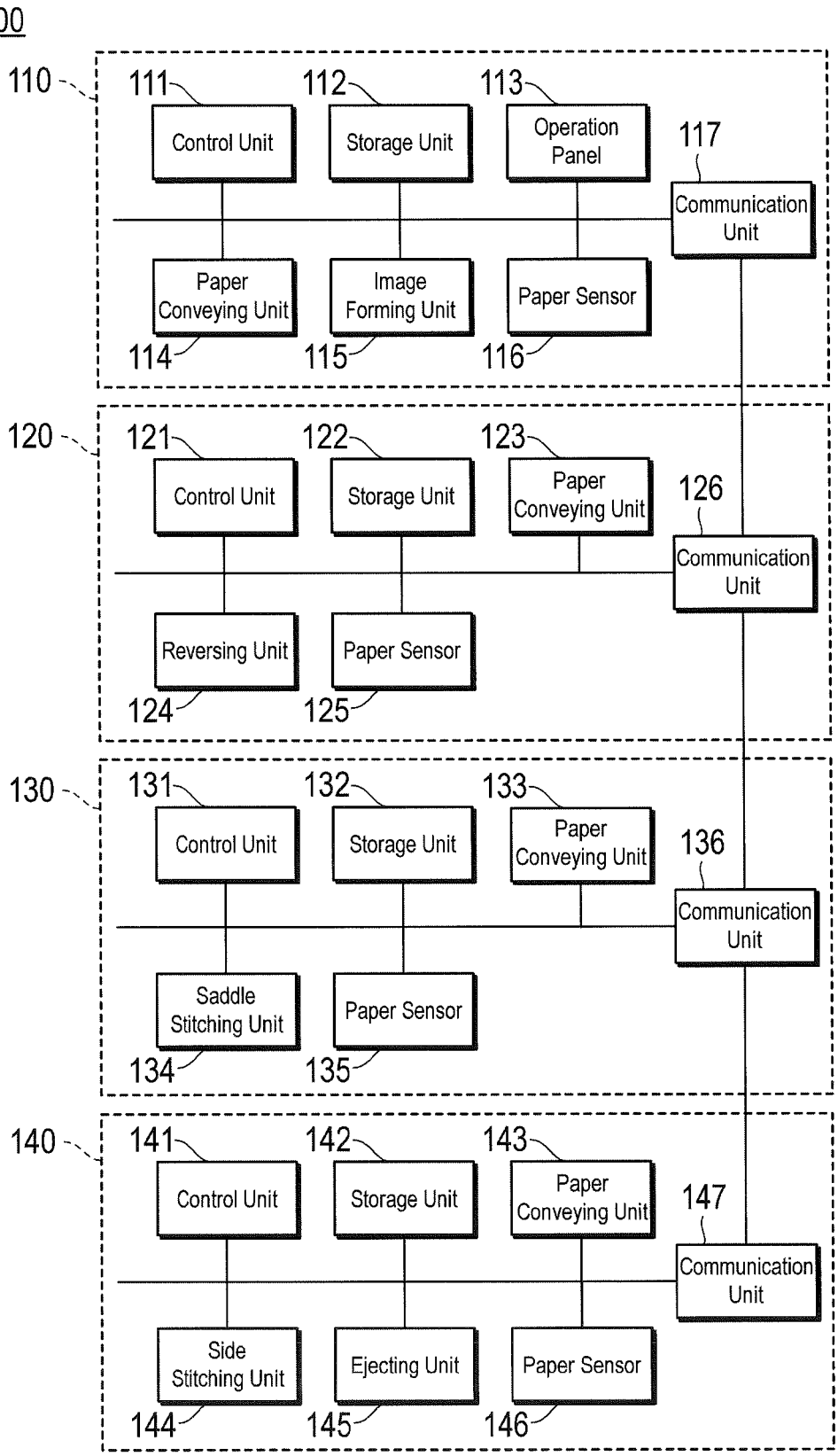
FIG. 2 is a block diagram illustrating a hardware configuration of the image forming system according to one or more embodiments of the present invention.

FIG. 1 is a perspective view illustrating an external appearance of an image forming system according to one or more embodiments of the present invention. FIG. 2 is a block diagram illustrating a hardware configuration of the image forming system according to one or more embodiments of the present invention.

As illustrated in FIGS. 1 and 2, the image forming system 100 includes an image forming device 110, a reversal conveyance device 120, a saddle stitching device 130, and a side stitching device 140. The image forming device 110 forms an image on a paper serving as a recording material to be used for printing. The reversal conveyance device 120 reverses front and back sides of a paper conveyed from the image forming device 110. The saddle stitching device 130 applies saddle stitching process such as folding or staple binding to the paper conveyed from the reverse conveyance device 120. The side stitching device 140 applies a side stitching process such as staple binding to the paper conveyed from the saddle stitching device 130. Description will be made for each configuration below.

<Image Forming Device 110>

The image forming device 110 includes a control unit 111 (may be referred to as "a controller"), a storage unit 112, an operation panel 113, a paper conveying unit 114, an image forming unit 115, a paper sensor 116, and a communication unit 117, which are connected to each other via a bus for exchanging signals.

The control unit 111 is a CPU (Central Processing Unit) that performs control of each unit and various types of arithmetic processing in accordance with programs.

The storage unit 112 is composed of a ROM (Read Only Memory) that stores beforehand various types of programs and various types of data, a RAM (Random Access Memory) that serves as a work area to temporarily store programs or data, a hard disc that stores various types of programs or various types of data, or the like.

The operation panel 113 includes a touch panel, a numeric key pad, a start button, a stop button, or the like, and is used to display various types of information and to input various types of instructions.

The paper conveying unit 114 conveys a paper serving as a recording medium to be used for printing. Papers are accommodated in a paper feed tray, and conveyed sheet by sheet to the image forming unit 115 along a conveyance path in the image forming device 110 by a paper feed mechanism provided in the paper feed tray.

The image forming unit 115 forms an image on the paper based on various types of data using a well-known image forming process such as an electro photographic process including the steps of charging, exposing, developing, transferring, and fixing. The image forming unit 115 may be equipped with the function of forming an image on both sides of the paper.

The paper sensor 116 is a plurality of line sensors provided at necessary positions in the conveyance path, for example. Each paper sensor 116 detects that the paper exists in the conveyance path at the position where it is provided, and notifies the result of the detection to the control unit 111.

The communication unit 117 is an interface for communicating with other devices. The communication unit 117 performs transmission and receipt of various types of set values, various types of information necessary for operation timing control, information about the detection of the paper by the paper sensor, information that indicates occurrence of a jam, or the like with the reversal conveyance device 120, the saddle stitching device 130, and the side stitching device 140.

The control unit 111 conveys the paper in the image forming device 110 by controlling the paper conveying unit 114. Further, the control unit 111 may detect, as a detection unit (may be referred to as "a detector"), a jam occurring in the image forming device 110 based on the result of the detection of the paper by the paper sensor 116. The detection unit may be provided separately from the control unit 111. The control unit 111 obtains, for example, as a paper passing time, the time from when the paper sensor 116 detects the leading end of the paper to when it detects the trailing end of the paper. The control unit 111 detects occurrence of a jam when the obtained paper passing time exceeds the jam detection time which is a preset threshold value. Meanwhile, the jam detection time is stored in the storage unit 112. Further, the control unit 111 communicates mutually with devices other than the image forming device 110 in the image forming system 100 (hereinafter referred to as "other devices"), such as the reversal conveyance device 120, the saddle stitching device 130, and the side stitching device 140, and receives information that indicates occurrence of a jam in the other devices.

When a jam occurs in the image forming device 110 or the other devices, the control unit 111 temporarily stops the conveyance of the paper in the image forming device 110 in order to prevent further occurrence of jam. Further, the control unit 111 transmits information that indicates the occurrence of the jam to the other devices and temporarily stops conveyance of the paper in the other devices as well. After the paper that has caused the jam is removed, the control unit 111 performs automatic purging for causing the paper remaining in the conveyance path to be automatically conveyed and ejected.

<Reversal Conveyance Device 120>

The reversal conveyance device 120 includes a control unit 121, a storage unit 122, a paper conveying unit 123, a reversing unit 124, a paper sensor 125, and a communication unit 126, which are connected to each other via a bus for exchanging signals. The storage unit 122, the paper sensor 125, and the communication unit 126 are similar in function to the storage unit 112, the paper sensor 116, and the communication unit 117 of the image forming device 110, respectively, and thus description thereof is omitted to avoid redundant description.

The control unit 121 performs control of each component described above, various types of arithmetic processing, or the like in accordance with programs. Based on instructions from the image forming device 110, the control unit 121 controls the paper conveying unit 123 and the reversing unit 124 to perform the conveyance and reversal of the paper.

The paper conveying unit 123 conveys the paper fed from the image forming device 110 along a conveyance path in the reversal conveyance device 120. The paper conveying unit 123 conveys the paper to the reversing unit 124 based on the setting of printing job or the like.

The reversing unit 124 reverses front and back sides of the paper in the conveyance path.

The control unit 121 detects a jam occurred in the reversal conveyance device 120 based on the result of the paper detection by the paper sensor 125. Upon detection of the jam, the control unit 121 controls the paper conveying unit 123 and stops the conveyance of the paper in the reversal conveyance device 120. Further, the control unit 121 transmits information that indicates the occurrence of the jam in the reversal conveyance device 120 to the image forming device 110 via the communication unit 126.

<Saddle Stitching Device 130>

The saddle stitching device 130 includes a control unit 131, a storage unit 132, a paper conveying unit 133, a saddle stitching unit 134, a paper sensor 135, and a communication unit 136, which are connected to each other via a bus for exchanging signals. The storage unit 132, the paper sensor 135, and the communication unit 136 are similar in function to the storage unit 112, the paper sensor 116, and the communication unit 117 of the image forming device 110, respectively, and thus description thereof is omitted to avoid redundant description.

The control unit 131 performs control of each component described above, various types of arithmetic processing, or the like in accordance with programs. Based on instructions from the image forming device 110, the control unit 131 controls the paper conveying unit 133 and the saddle stitching unit 134, and performs conveyance of and saddle stitching process for the paper.

The paper conveying unit 133 conveys the paper fed from the reversal conveyance device 120 along a conveyance path in the saddle stitching device 130. The paper conveying unit 133 conveys the paper to the saddle stitching unit 134 based on the setting of printing job or the like.

The saddle stitching unit 134 is composed of a folding unit that center-folds the paper, and a stapling unit that staples a bundle of the center-folded papers and binds the paper bundle, and saddle-stitches the paper bundle to create a booklet.

The control unit 131 detects a jam occurred in the saddle-stitching device 130 based on the result of the paper detection by the paper sensor 135. Upon detection of the jam, the control unit 131 controls the paper conveying unit 133 and stops the conveyance of the paper in the saddle-stitching device 130. Further, the control unit 131 transmits information that indicates the occurrence of the jam in the saddle-stitching device 130 to the image forming device 110 via the communication unit 136.

<Side Stitching Device 140>

The side stitching device 140 includes a control unit 141, a storage unit 142, a paper conveying unit 143, a side stitching unit 144, an ejecting unit 145, a paper sensor 146, and a communication unit 147, which are connected to each other via a bus for exchanging signals. The storage unit 142, the paper sensor 146, and the communication unit 147 are similar in function to the storage unit 112, the paper sensor 116, and the communication unit 117 of the image forming device 110, respectively, and thus description thereof is omitted to avoid redundant description.

The control unit 141 performs control of each component described above, various types of arithmetic processing, or the like in accordance with programs. Based on instructions from the image forming device 110, the control unit 141 controls the paper conveying unit 143 and the side stitching unit 144, and performs conveyance of and side stitching process for the paper.

The paper conveying unit 143 conveys the paper fed from the saddle stitching device 130 along a conveyance path in the side stitching device 140. The paper conveying unit 143 conveys the paper to the side stitching unit 144 based on the setting of printing job or the like.

The side stitching unit 144 performs stapling of a paper bundle at positions away by a predetermined distance from the end of the paper bundle, and side-stitches the paper bundle to create a booklet.

The ejecting unit 145 ejects outside the side stitching device 140 the printed matter subjected to post-processing such as side stitching.

The control unit 141 detects a jam occurred in the side stitching device 140 based on the result of the paper detection by the paper sensor 146. Upon detection of the jam, the control unit 141 controls the paper conveying unit 143 and stops the conveyance of the paper in the side stitching device 140. The control unit 141 transmits information that indicates the occurrence of the jam in the side stitching device 140 to the image forming device 110 via the communication unit 147.

Meanwhile, each of the image forming device 110, the reversal conveyance device 120, the saddle stitching device 130, and the side stitching device 140 may include other components than the above-described ones, or some of the above-mentioned components may be not included.

<Image Forming System 100>

Figure 3:
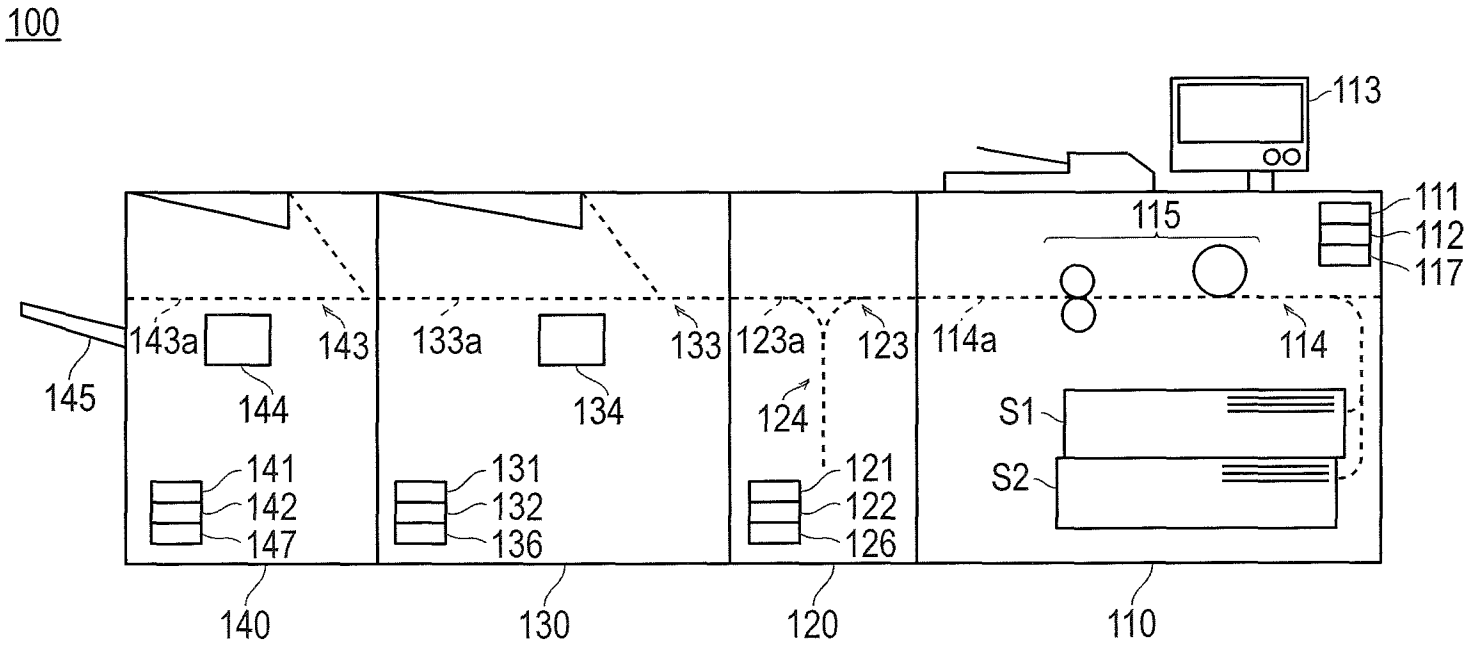
FIG. 3 is a view illustrating a schematic configuration of the image forming system according to one or more embodiments of the present invention.

FIG. 3 is a view illustrating a schematic configuration of the image forming system.

As illustrated in FIG. 3, the image forming system 100 includes the image forming device 110, the reversal conveyance device 120, the saddle stitching device 130, and the side stitching device 140, and is composed of these devices being interconnected with each other. Paper are passed through the image forming device 110, the reversal conveyance device 120, the saddle stitching device 130, and the side stitching device 140 in the named order. The paper, on which an image is formed by the image forming device 110, is conveyed to the reversal conveyance device 120, the saddle stitching device 130, and the side stitching device 140 to be subjected to necessary process, and then outputted as a printed matter.

The image forming device 110 controls the paper conveying unit 114 by the control unit ill, and conveys papers fed from paper feed trays S1 and S2 along a conveyance path 114*a*. Further, the image forming device 110, through control unit ill, controls the image forming unit 115 to form an image on the paper.

The reversal conveyance device 120 controls the paper conveying unit 123 by the control unit 121 to convey the paper fed from the image forming device 110 along a conveyance path 123*a*. Further, the reversal conveyance device 120 controls the paper conveying unit 123 and the reversing unit 124 by the control unit 121, to reverse the paper based on instructions from the image forming device 110 or the like.

The saddle stitching device 130 controls the paper conveying unit 133 by the control unit 131, to convey the paper fed from the reversal conveyance device 120 along a conveyance path 133*a*. Further, the saddle stitching device 130 controls the paper conveying unit 133 and the saddle stitching unit 134, to apply saddle stitching process to a paper bundle based on instructions from the image forming device 110 or the like. The booklet, which has been subjected to the saddle stitching process, is ejected from the saddle stitching device 130 by a predetermined ejection method.

The side stitching device 140 controls the paper conveying unit 143 by the control unit 141, to convey the paper fed from the saddle stitching device 130 along a conveyance path 143*a*. Further, the side stitching device 140 controls the paper conveying unit 143 and the side stitching unit 144, to apply a side stitching process to the paper bundle based on instructions from the image forming device 110 or the like. The booklet, which has been subjected to the side stitching process, is ejected from the side stitching device 140 by the ejecting unit 145.

Description will next be made of a case in which when a jam occurs in the image forming system 100, papers are caused to overlap each other, and are stopped.

Figure 4:
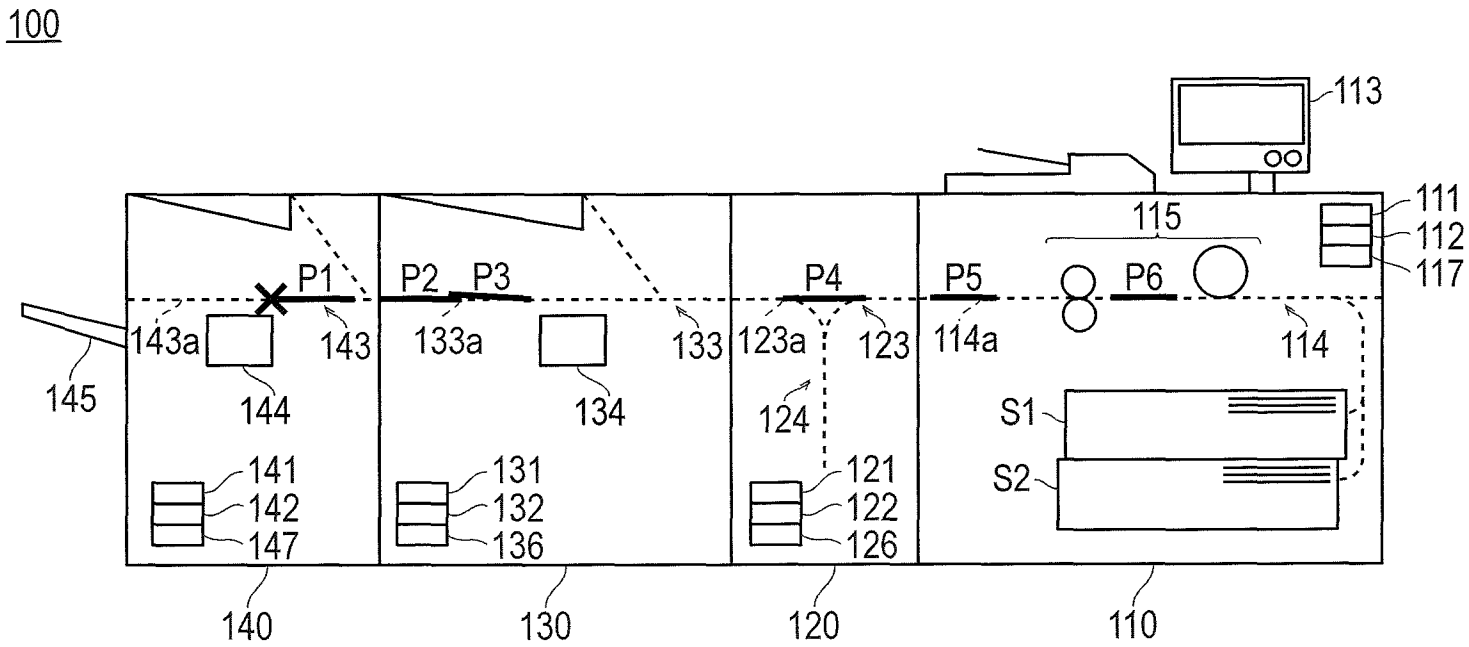
FIG. 4 is a view illustrating a state in which papers are caused to overlap each other and are stopped when a jam occurs in the image forming system according to one or more embodiments of the present invention.

FIG. 4 is a view illustrating a state in which papers are caused to overlap each other and are stopped when a jam occurs in the image forming system.

As illustrated in FIG. 4, a jam has occurred at a point marked X in the side stitching device 140 located at the most downstream position in the image forming system 100. On the conveyance path of the image forming system 100, there remain papers P2, P3, P4, P5, and P6, besides the paper P1 which has caused the jam. The papers P2 and P3 exist on the conveyance path 133*a* of the saddle stitching device 130. The paper P4 exists on the conveyance path 123*a* of the reversal conveyance device 120. The papers P5 and P6 exist on the conveyance path 114*a* of the image forming device 110.

First, when a jam occurs on the conveyance path 143*a* of the side stitching device 140, the side stitching device 140 stops conveyance of the paper in the side stitching device 140 and thereupon transmits jam occurrence information that indicates the occurrence of the jam to the image forming device 110.

Upon receipt of the jam occurrence information from the side stitching device 140, the image forming device 110 stops conveyance of the paper in the image forming device 110, and transmits the jam occurrence information to the reversal conveyance device 120 and the saddle stitching device 130, which are the other devices.

Subsequently, upon receipt of the jam occurrence information from the image forming device 110, the reversal conveyance device 120 and the saddle stitching device 130 each stop conveyance of the paper in the reversal conveyance device 120 and the saddle stitching device 130.

As described above, there occurs a time lag between the timing when the side stitching device 140 stops conveyance of the paper and the timing when the saddle stitching device 130 upstream of the side stitching device 140 stops conveyance of the paper due to the intervention of the communication process and the control process. Thus, even when the side stitching device 140 stops conveyance of the paper, the side stitching device 130 continues conveyance of the paper until the side stitching device 130 receives the jam occurrence information from the image forming device 110. The saddle stitching device 130 tends to convey and eject the paper P2 to the side stitching device 140. However, since the side stitching device 140 has stopped conveyance of the paper, it is not possible for the saddle stitching device 130 to eject the paper P2 to the side stitching device 140. Consequently, the paper P2 is stopped at the end of the conveyance path 133*a* of the saddle stitching device 130. Then, since the saddle stitching device 130 is continuing conveyance of the paper, the leading end of the succeeding paper P3 overlaps the trailing end of the stopped paper P2 as illustrated in FIG. 4. In such a state, when the saddle stitching device 130 receives the jam occurrence information from the saddle stitching device 130, the papers P2 and P3 are stopped while overlapping each other.

In the state illustrated in FIG. 4, when the paper P1 which has caused the jam is removed, the image forming system 100 performs automatic purging so that the papers P2 to P6 are automatically conveyed along the conveyance path and ejected outside the image forming system 100. Then, the papers P2 and P3 may be conveyed while overlapping each other. When the papers P2 and P3 are conveyed while overlapping with each other, a state occurs in which no gap exists between the papers P2 and P3. In this instance, the control unit 141 obtains, as a paper passing time, the time from when the paper sensor 146 detects the leading end of the paper P2 to when it detects the trailing end of the paper P3. Thus, when the papers are conveyed while overlapping with each other, a longer paper passing time is detected than when papers are conveyed sheet by sheet. Therefore, for example, when a predetermined threshold value of the paper passing time for detecting a jam is set based on the time that a sheet of paper passes, a jam is detected due to papers being conveyed while overlapping each other.

<Overview of Jam Detection Process During Automatic Purging in the Image Forming System 100>

Figure 5:
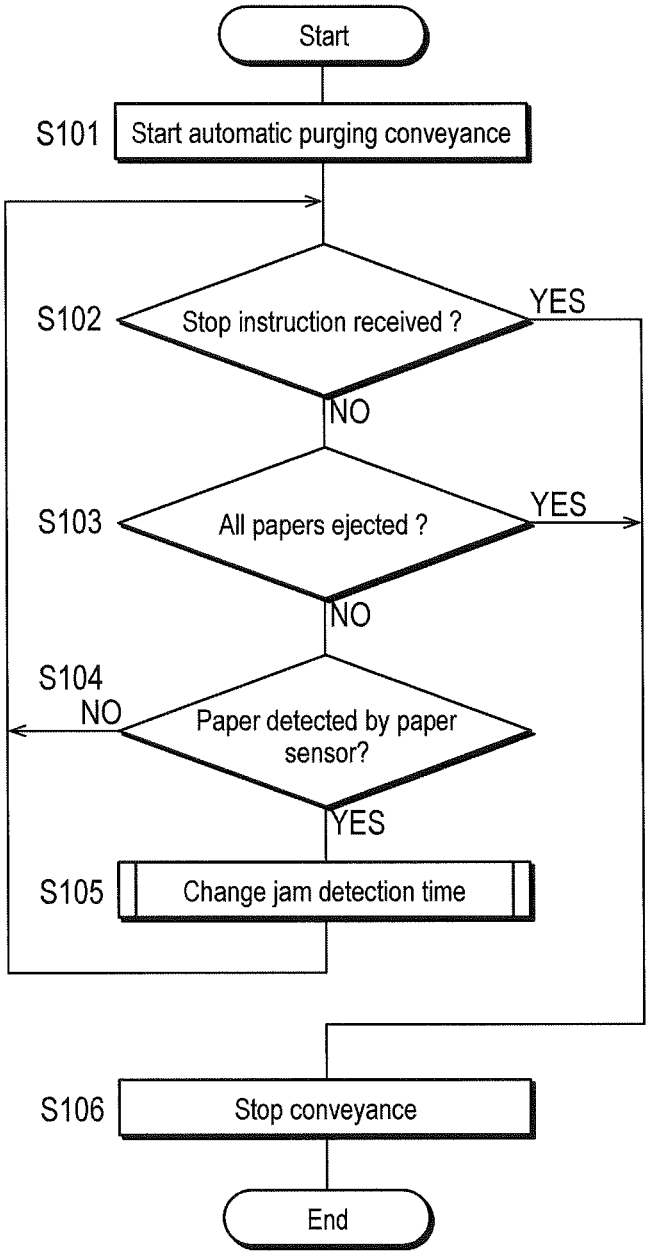
FIG. 5 is a flowchart illustrating a procedure of a jam detection process during automatic purging in the image forming system according to one or more embodiments of the present invention.

FIG. 5 is a flowchart illustrating a procedure of jam detection process during automatic purging in the image forming system. The algorithm illustrated in the flowchart of FIG. 5 is stored as a program in the storage unit 112 of the image forming device 110 and executed by the control unit 111. When the process illustrated in the flowchart of FIG. 5 is performed, a jam is detected in the image forming system 100, and the paper remaining in the image forming system 100 is temporarily stopped.

As illustrated in FIG. 5, the image forming system 100 starts re-conveyance of the paper by automatic purging (Step S101). Specifically, the control unit 111 of the image forming device 110 mutually communicates with each unit of the image forming device 110 and the other devices, and transmit an instruction to the effect of starting re-conveyance of the paper. The image forming system 100 conveys the paper remaining in the image forming system 100 in order to eject it.

Subsequently, the image forming system 100 determines whether it has received a stop instruction (Step S102). Specifically, the control unit 111 of the image forming device 110 determines whether it has received a stop instruction from the user via the operation panel 113, a stop instruction due to a variety of errors, or the like.

When having received a stop instruction (Yes in Step S102), the image forming system 100 stops the conveyance operation (Step S106), and ends the jam detection process.

When having not received a stop instruction (No in Step S102), the image forming system 100 determines whether all papers have been ejected (Step S103).

When all papers have been ejected (Yes in Step S103), the image forming system 100 stops the conveyance operation (Step S106), and ends the jam detection process.

When all papers have not been ejected (No in Step S103), the image forming system 100 determines whether the existence of the paper is detected by the paper sensor provided in each device (Step S104).

When the existence of the paper is not detected (No in Step S104), the image forming system 100 returns to the process of Step S102.

When the existence of paper is detected (Yes in Step S104), the image forming system 100 changes a jam detection time (Step S105). Details of the process for changing the jam detection time will be described hereinafter.

Subsequently, the image forming system 100 conveys paper while performing jam detection in accordance with the jam detection time set in the process of Step S105, and returns to the process of Step S102. The image forming system 100 repeats the process of Steps S102-S105 until all papers have been ejected.

<Process for Changing the Jam Detection Time>

Figure 6A:
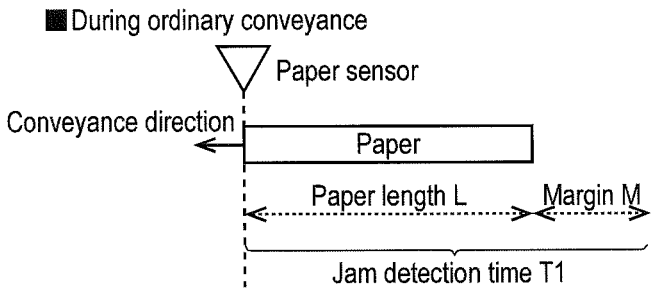
FIGS. 6A and 6B are views for explaining an example of a process for changing a jam detecting time illustrated at Step S105 in FIG. 5.
Figure 6B:
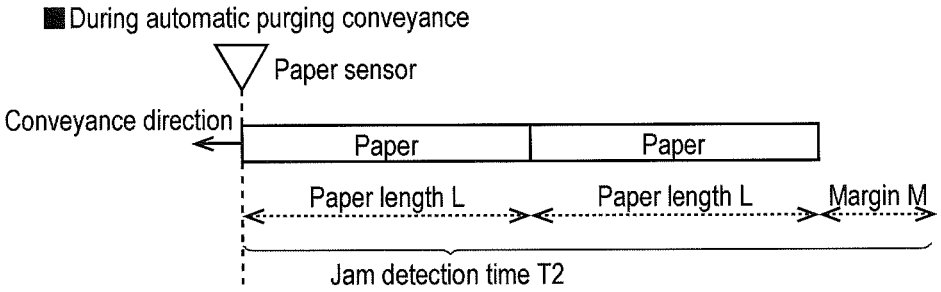

FIGS. 6A and 6B are views for explaining the process for changing the jam detection time illustrated at Step S105 of FIG. 5. FIG. 6A is a view for explaining a method for calculating the jam detection time for ordinary paper conveyance, and FIG. 6B is a view for explaining an example of a method for calculating jam detection time for automatic purging.

First, as illustrated in FIG. 6A, during ordinary paper conveyance, the time necessary for the length L in the conveyance direction of the paper (hereinafter referred to as "paper length L") to pass the paper sensor plus a predetermined margin M is set as a jam detection time T1. The value of the margin M is arbitrarily set taking into account of a skew of the paper, a slip rate of the paper or the like.

The jam detection time T1 for ordinary conveyance is calculated by the following equation 1 using the paper conveyance speed S, the paper length L of the paper, and the margin M:

$$T1=L/S+M \quad \text{(Equation 1)}$$

In the example of FIG. 6A, let it be assumed that the paper conveyance speed S is 1000 [mm/s], the paper length L of the paper is 210 [mm], and the margin M is 0.1 [s]. In this instance, in accordance with Equation 1, the jam detection time T1 for ordinary conveyance is calculated as 210 [mm]/1000 [mm/s]+0.1 [s]=310 [ms]. Each of the devices included in the image forming system 100 stores beforehand the above-mentioned jam detection time T1 in the storage unit and detects a jam using the jam detection time T1 for ordinary paper conveyance.

Then, as illustrated in FIG. 6B, during automatic purging, the time necessary for the length of two sheets of paper having a paper length L to pass the paper sensor plus a predetermined margin M is set as a jam detection time T2.

The jam detection time T2 for automatic purging is calculated by the following equation 2 using the paper conveyance speed S, the paper length L of the paper, and the margin M:

$$T2=L\times 2/S+M \quad \text{(Equation 2)}$$

When the paper is re-conveyed by automatic purging as described above, papers are in some cases conveyed while overlapping each other. In a state that the papers are conveyed while overlapping each other, when jam detection is performed using the jam detection time T1 for ordinary paper conveyance, the paper passing time exceeds the jam detection time T1, and this is detected as a jam. Therefore, according to one or more embodiments, the time for two sheets of paper to pass the paper sensor is set as the jam detection time T2 for automatic purging, in view of a case where two sheets of paper overlap each other and the paper length becomes maximum.

In the example of FIG. 6B, let it be assumed that the paper conveyance speed S is 1000 [mm/s], the paper length L of the paper is 210 [mm], and the margin M is 0.1 [s]. In this instance, in accordance with the equation 2, the jam detection time T2 for automatic purging is calculated as 210 [mm]×2/1000 [mm/s]+0.1 [s]=520 [ms].

The control unit 111 of the image forming device 110 stores in the storage unit 112 the above-calculated jam detection time T2 for automatic purging in the process illustrated at Step S105 of FIG. 5. Further, the control unit 111 also transmits the jam detection time T2 for automatic purging to the other devices. The other devices store the received jam detection time T2 for automatic purging in the storage unit of each device.

In this manner, each of the devices in the image forming system 100 changes the jam detection time T1 for ordinary paper conveyance to the jam detection time T2 for automatic purging which is larger than T1 and detects a jam.

As above, according to the image forming system 100 of one or more embodiments, when the paper is re-conveyed after being temporarily stopped due to occurrence of a jam, the jam detection time T1 is changed to the jam detection time T2 that is longer than the jam detection time T1 and the jam is detected. Thus, when the papers are conveyed while overlapping each other, automatic purging can be appropriately performed without erroneously determining it as a jam. Consequently, the productivity of printing can be increased.

Further, the image forming system 100 determines the jam detection time T2 based on the paper length of the paper. Thus, it is possible, when papers are conveyed while overlapping each other, to avoid erroneously determining it as a jam, and it is also possible, when a j am actually occurs, to quickly detect the jam. Consequently, automatic purging can be performed more effectively, and the productivity of printing can be increased.

<Modification 1>

According to one or more embodiments, an example has been described in which the jam detection time T2 for automatic purging is calculated by adding the margin to the time necessary for two sheets of paper to pass the paper sensor. However, the method for calculating the jam detection time is not limited thereto. For example, when the paper is stopped at a position where the leading end of the paper is past the paper sensor and automatic purging is performed from such a state, the jam detection time T3 may be calculated taking into account of the distance of the leading end of the paper past the paper sensor.

Figure 7:
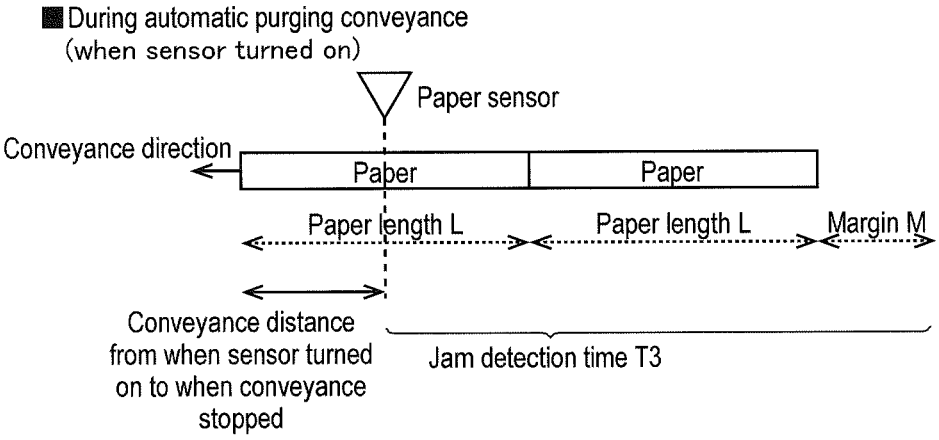
FIG. 7 is a view for explaining an example of a method for calculating the jam detection time taking into account of a distance of the leading end of the paper past the paper sensor.

FIG. 7 is a view for explaining a method for calculating the jam detection time taking into account of the distance of the leading end of the paper past the paper sensor.

In the example illustrated in FIG. 7, the paper is stopped at the position where the leading end of the paper is past the paper sensor after occurrence of a jam. When automatic purging is performed from this state, the control unit 111 of the image forming device 110 calculates the jam detection time T3 by subtracting the distance E of the leading end of the paper past the paper sensor from the length of two sheets of paper. Then, the jam detection time T3 is calculated by the following equation 3:

$$T3=(L\times 2-E)/S+M \quad \text{(Equation 3)}$$

The state that the paper is stopped at the position where the leading end of the paper is past the paper sensor is determined based on the paper sensor having detected the paper when the paper is stopped. Further, the distance of the leading end of the paper past the paper sensor is, for example, calculated by multiplying the time taken from when the paper is detected by the paper sensor (the paper sensor is ON) to when the paper is stopped by the paper conveyance speed S.

In the example of FIG. 7, let it be assumed that the paper conveyance speed S is 1000 [mm/s], the paper length L of the paper is 210 [mm], and the margin M is 0.1 [s]. Further let it be assumed that the distance of the leading end of the paper past the paper sensor is 105 [mm]. In this instance, in accordance with the equation 3, the jam detection time T3 for automatic purging is calculated as (210 [mm]×2−105 [mm])/1000 [mm/s]+0.1 [s]=415 [ms].

As above, when the paper is stopped at a position where the leading end of the paper is past the paper sensor after occurrence of a jam, the image forming system 100 of the present modification calculates the jam detection time T3 by subtracting the distance E of the leading end of the paper past the paper sensor from the length of the overlapping portion of the papers. Thus, it is possible, when papers are conveyed while overlapping each other, to avoid erroneously determining it as a jam, and it is also possible, when a jam actually occurs, to quickly detect the jam.

<Modification 2>

According to one or more embodiments, an example has been described in which the jam detection time is calculated with the margin M being a fixed value. However, the method for calculating the jam detection time is not limited thereto. For example, the jam detection time may be calculated by changing the value of the margin M depending on the size of the paper.

Figure 8A:
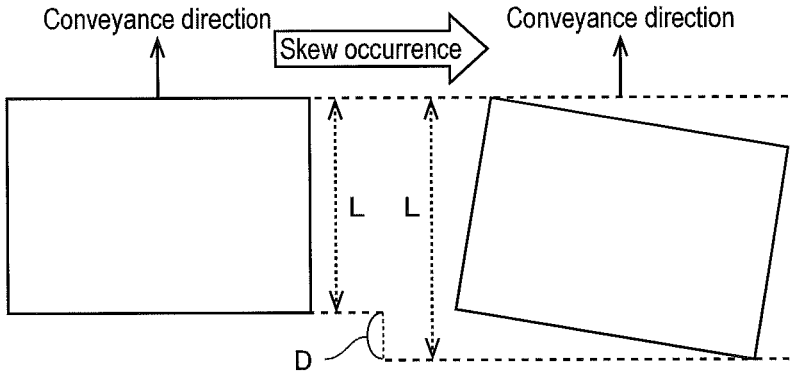
FIGS. 8A and 8B are views for explaining an example of a method for calculating the jam detection time by changing the value of a margin depending on the size of the paper.
Figure 8B:
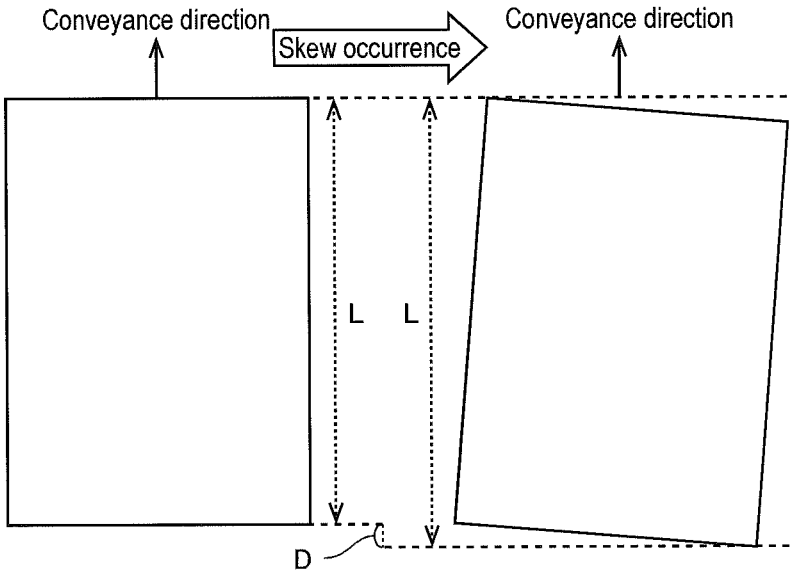

FIGS. 8A and 8B are views for explaining a method for calculating the jam detection time by changing the value of the margin depending on the size of the paper. FIG. 8A illustrates a state in which a skew occurs when the paper length L is short, and FIG. 8B illustrates a state in which a skew occurs when the paper length L is long.

As described above, the margin M is an adjustment value provided in view of a skew of the paper with respect to the paper conveyance direction. For example, as illustrated in FIG. 8A, when a skew occurs, the paper length L of the paper in the conveyance direction is increased by a difference D. Due to this difference D, the paper passing time is increased. Thus, a value that is an addition of the margin M to an ideal paper passing time when no skew exists is set up as the jam detection time.

There is a tendency that the shorter the paper length L, the more likely a skew is to occur while the longer the paper length L, the less likely a skew is to occur. When the paper length L is short as in FIG. 8A, the number of conveyance rollers for holding the paper therebetween is small so that the paper becomes likely to skew when it is transferred between the conveyance rollers. In this instance, the value of the difference D is increased, and value of the necessary margin M is also increased. Meanwhile, when the paper length L is long as in FIG. 8B, the number of conveyance rollers for holding the paper therebetween is large so that the paper becomes less likely to skew even when it is transferred between the conveyance rollers. In this instance, the value of the difference D is decreased, and the value of the necessary margin M is also decreased. Thus, in the present modification, when the paper length L of the paper is short, the margin M is increased, while when the paper length L of the paper is long, the margin M is decreased.

An example will be described below in which the value of the margin M is set to be inversely proportional to the value of the paper length L. Let it be assumed, for example, that when A4 paper of which the paper length L is 210 [mm] is conveyed, the margin M is set to 0.1 [s]. In this instance, since when A3 paper of which the paper length L is 420 [mm] is conveyed, the paper length L is twice as long as that of A4 paper, the margin M can be reduced to ½ times of that of A4 paper, i.e., 0.05 [s]. Let it be assumed here that the paper conveyance speed S is 1000 [mm/s], and the paper length L of the paper is 420 [mm]. In this instance, in accordance with the equation 2, the jam detection time T4 for automatic purging is calculated as (420 [mm]×2)/1000 [mm/s]+0.05 [s]=890 [ms].

As above, the image forming system 100 of the present modification changes the value of the margin M depending on the paper length of the paper, and calculates the jam detection time T4. In this manner, it is possible to appropriately set the margin M taking into account of the skew of the paper which varies depending on the paper length of the paper. Thus, it is possible, when papers are conveyed while overlapping each other, to reliably avoid erroneously determining it as a jam, and it is also possible, when a jam actually occurs, to quickly detect the jam. Consequently, automatic purging can be performed more effectively, and the productivity of printing can be increased.

<Modification 3>

According to one or more embodiments, an example has been described in which when the paper is stopped due to occurrence of a jam, the jam detection time is calculated on the assumption that the maximum number of overlapping sheets of paper is two (2). However, the method for calculating the jam detection time is not limited thereto. For example, the jam detection time may be calculated by changing the expected maximum value N for the number of overlapping sheets of paper (hereinafter, referred to as "maximum overlapping sheet number") depending on a cycle time of the paper.

The cycle time is a value that indicates a temporal interval of conveyance when a plurality of papers are conveyed in the image forming system 100. The cycle time corresponds to the value of productivity (printing speed) that indicates the number of sheets which are print-outputted per unit time. For example, when the productivity is 60 [ppm] (page per minute), the cycle time is one (1) second. When the productivity is 120 [ppm], the cycle time is 0.5 seconds. The set value for the cycle time or productivity is stored beforehand in the storage unit 112 of the image forming device 110 or the like.

When the cycle time is long, the distance between the respective papers to be conveyed is kept long. Thus, the maximum overlapping sheet number N is decreased when the papers are stopped due to occurrence of a jam. Meanwhile, when the cycle time is short, the distance between the respective papers to be conveyed is decreased so that the respective papers are conveyed in a state of being close to each other. In this manner, the maximum overlapping sheet number N is increased when the papers are stopped due to occurrence of a jam. Therefore, in the present modification, when the cycle time is long, the maximum overlapping sheet number N is decreased, while when the cycle time is short, the maximum overlapping sheet number N is increased.

An example will be described below in which the maximum overlapping sheet number is changed depending on the set value for the productivity corresponding to the cycle time.

FIG. 9 is a view illustrating a configuration example of the relationship in correspondence between the set value for the productivity and the maximum overlapping sheet number.

As illustrated in FIG. 9, information representing the relationship in correspondence between the set value for the productivity and the maximum overlapping sheet number is stored in the storage unit 112 of the image forming device 110. In the example of FIG. 9, when the set value for the productivity is equal to or less than 40 [ppm], 1 [sheet] is set as the maximum overlapping sheet number N. When the set value for the productivity is equal to or more than 41 [ppm] and equal to or less than 60 [ppm], 2 [sheet] is set as the maximum overlapping sheet number N. When the set value for the productivity is equal to or more than 61 [ppm] and equal to or less than 120 [ppm], [sheet] is set as the maximum overlapping sheet number N. In the present modification, the jam detection time T5 for automatic purging is calculated by the following equation 4:

$$T5=L\times N/S+M \quad \text{(Equation 4)}$$

Description will now be made of a specific method of calculating the jam detection time T5 on the assumption that the paper conveyance speed S is 1000 [mm/s], the paper length L of the paper is 210 [mm], and the margin M is 0.1 [s].

When the set value for the productivity is equal to or less than 40 [ppm], the maximum overlapping sheet number N is 1 [sheet]. This is an assumption that the papers are conveyed sheet by sheet without overlapping each other. In this instance, in accordance with the equation 4, the jam detection time T5 is calculated as 210 [mm]×1/1000 [mm/s]+0.1 [s]=310 [ms].

When the set value for the productivity is equal to or more than 41 [ppm] and equal to or less than 60 [ppm], the maximum overlapping sheet number is 2 [sheet]. This is an assumption that the papers are conveyed with two (2) sheets at maximum overlapping each other. In this instance, in accordance with the equation 4, the jam detection time T5 is calculated as 210 [mm]×2/1000 [mm/s]+0.1 [s]=520 [ms].

When the set value for the productivity is equal to or more than 61 [ppm] and equal to or less than 120 [ppm], the maximum overlapping sheet number N is 3 [sheet]. This is an assumption that the papers are conveyed with three (3) sheets at maximum overlapping each other. In this instance, in accordance with the equation 4, the jam detection time T5 is calculated as 210 [mm]×3/1000 [mm/s]+0.1 [s]=730 [ms].

As above, the image forming system 100 of the present modification calculates the jam detection time T5 by changing the expected maximum number N of the overlapping sheets of paper depending on the cycle time of the paper. In this manner, it is possible to properly set the jam detection time T5 by setting the maximum number of the overlapping sheets of paper taking into account of the inter-paper distance that varies depending on the cycle time. Thus, it is possible, when papers are conveyed while overlapping each other, to reliably avoid erroneously determining it as a jam, and it is also possible, when a jam actually occurs, to quickly detect the jam.

Meanwhile, according to one or more embodiments, the description has been made on the assumption that the image forming system 100 includes the image forming device 110, the reversal conveyance device 120, the saddle stitching device 130, and the side stitching device 140, but there is no limitation thereto. The image forming system 100 may include other devices than the above-described devices, or some of the above-described devices may be not included.

Further, according to one or more embodiments, the description has been made on the assumption that each of the devices such as the image forming device 110 is a device provided as a separate entity, but there is no limitation thereto. The respective devices may be configured integrally or may be configured as included in other devices. For example, a variety of post-processing devices such as the reversal conveyance device 120, the saddle stitching device 130, and the side stitching device 140 may be included in the image forming device 110. Alternatively, a post-processing device having a plurality of post-processing functions such as reversal conveyance, saddle stitching, or side stitching may be applied to the image forming system 100.

Further, according to one or more embodiments, the respective procedures such as the process for changing the jam detection time which have been described as performed by the image forming device 110 may be performed by a post-processing device such as the reversal conveyance device 120, the saddle stitching device 130, or the side stitching device 140. Alternatively, such procedures may be performed by a server, a controller, or the like provided in the image forming system 100.

Further, in the foregoing description, the methods for calculating the jam detection times T2-T5 have been described as separately independent methods. However, the methods for calculating the jam detection times T2-T5 may be combined with each other. For example, the jam detection time may be calculated by determining the value for the margin M depending on the paper length of the paper and determining the maximum overlapping sheet number depending on the cycle time.

Further, according to one or more embodiments, the description has been made on the assumption that the same jam detection time can be set uniformly in each device in the image forming system 100, but there is no limitation thereto. The jam detection time may be set as a value that differs from device to device or as a value that differs from paper sensor to paper sensor. For example, when a paper having a long paper length is remaining only in a downstream portion of the image forming system 100, the jam detection time may be set based on a long paper length in a downstream-side device or paper sensor and may be set based on a short paper length in an upstream-side device or paper sensor.

Further, according to one or more embodiments, an example has been described in which the jam detection time is set once after automatic purging is started, and the same jam detection time is used during automatic purging, but there is no limitation thereto. For example, each time each paper sensor detects a paper, the jam detection time may be set based on the size of the paper or the like.

Further, according to one or more embodiments, an example has been described in which automatic purging is performed by temporarily stopping all papers remaining in the image forming system 100 after occurrence of a jam, but there is no limitation thereto. For example, a pre-purging process may be applied to eject, from a sub paper ejection tray provided in each device, papers remaining in the image forming system 100 after occurrence of a jam, thereby ejecting a paper, which can be ejected, before automatic purging is performed. By performing the process of one or more embodiments after the pre-purging process has been applied, it is possible to perform automatic purging more smoothly.

Further, according to one or more embodiments, an example has been described in which a jam has occurred in the side stitching device 140 which is a post-processing device, but there is no limitation thereto. The image forming system 100 may also perform the process of one or more embodiments when a jam has occurred in the image forming device 110 or other post-processing devices.

Further, according to one or more embodiments, an example has been described in which image formation is performed by the image forming device 110 using a toner in accordance with an electro photographic system, but there is no limitation thereto. The image forming device 110 may be one that performs image formation using ink in accordance with an ink-jet system.

Further, according to one or more embodiments, an example has been described in which a paper is conveyed with an image formed thereon by the image forming device 110, but there is no limitation thereto. The recording material which is conveyed with an image formed thereon by the image forming device 110 is not limited to paper, but may be any one of various recording materials which are formed of a plastic, a metal, or the like.

The means and method for performing the various process in the image forming system according to one or more embodiments may be implemented by either one of a specialized hardware and a programmed computer. The above program may be provided by being recorded in a computer readable recording medium such as a flexible disc, CD-ROM, or the like, or may be provided on line via a network such as Internet or the like. In this instance, the program recorded in the computer readable recording medium is ordinarily transferred to and stored in a storage unit such as a hard disc or the like. Further, the above program may be provided as a separate application software, or may be incorporated, as one of the functions of the image forming system, into the software of the pertinent device.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming system, comprising:

an image forming device that forms an image on a recording material;

a post-processing device that conducts post-processing to the recording material;

a detector that detects a first conveyance abnormality of the recording material when a time taken for the recording material conveyed along a conveyance path in the image forming system to pass a predetermined position exceeds a first threshold value; and a controller that:

temporarily stops the conveyance of the recording material when the first conveyance abnormality is detected by the detector;

changes the first threshold value to a second threshold value larger than the first threshold value when the conveyance of the recording material is temporarily stopped, wherein the second threshold value is referenced from a re-conveyance of the recording material along the conveyance path after the recording material is temporarily stopped; and when the re-conveyance is made to eject the recording material remaining in the conveyance path, causes the detector to detect a second conveyance abnormality based on the second threshold value.

2. The image forming system according to claim 1, wherein the controller determines the second threshold value based on a size of the recording material.

3. The image forming system according to claim 1, wherein the controller determines the second threshold value based on a cycle time to convey the recording material.

4. The image forming system according to claim 1, wherein the first conveyance abnormality detected by the detector occurs directly after a start of conveyance.

5. The image forming system according to claim 1, wherein the second threshold value is determined by combining the first threshold value with a conveyance time of a length of the recording material in the conveyance direction.

6. An image forming device connected to a post-processing device to configure an image forming system, comprising:

a detector that detects a first conveyance abnormality of a recording material when a time taken for the recording material conveyed along a conveyance path in the image forming system to pass a predetermined position exceeds a first threshold value; and a controller that:

temporarily stops the conveyance of the recording material when the first conveyance abnormality is detected by the detector;

changes the first threshold value to a second threshold value larger than the first threshold value when the conveyance of the recording material is temporarily stopped, wherein the second threshold value is referenced from a re-conveyance of the recording material along the conveyance path after the recording material is temporarily stopped; and when the re-conveyance is made to eject the recording material remaining in the conveyance path, causes the detector to detect a second conveyance abnormality based on the second threshold value.

7. The image forming device according to claim 6, wherein the first conveyance abnormality detected by the detector occurs directly after a start of conveyance.

8. The image forming device according to claim 6, wherein the second threshold value is determined by combining the first threshold value with a conveyance time of a length of the recording material in the conveyance direction.

9. A post-processing device connected to an image forming device to configure an image forming system, comprising:

a post-processor that post-processes a recording material on which an image is formed by the image forming device;

a detector that detects a first conveyance abnormality of the recording material when a time taken for the recording material conveyed along a conveyance path in the image forming system to pass a predetermined position exceeds a first threshold value; and a controller that:

temporarily stops the conveyance of the recording material when the first conveyance abnormality is detected by the detector;

changes the first threshold value to a second threshold value larger than the first threshold value when the conveyance of the recording material is temporarily stopped, wherein the second threshold value is referenced from a re-conveyance of the recording material along the conveyance path after the recording material is temporarily stopped; and when the re-conveyance is made to eject the recording material remaining in the conveyance path, causes the detector to detect a second conveyance abnormality based on the second threshold value.

10. The post processing device according to claim 9, wherein the first conveyance abnormality detected by the detector occurs directly after a start of conveyance.

11. The non-transitory computer readable recording medium according to claim 10, wherein the first conveyance abnormality detected by the detector occurs directly after a start of conveyance.

12. The non-transitory computer readable recording medium according to claim 10, wherein the second threshold value is determined by combining the first threshold value with a conveyance time of a length of the recording material in the conveyance direction.

13. The post processing device according to claim 9, wherein the second threshold value is determined by combining the first threshold value with a conveyance time of a length of the recording material in the conveyance direction.

14. A non-transitory computer readable recording medium stored with a conveyance abnormality detection program applied to an image forming system comprising an image forming device that forms an image on a recording material, and a post-processing device that post-processes a recording material, wherein the conveyance abnormality detection program causes a computer to execute:

detecting a first conveyance abnormality of the recording material when a time taken for the recording material conveyed along a conveyance path in the image forming system to pass a predetermined position exceeds a first threshold value;

temporarily stopping the conveyance of the recording material when the first conveyance abnormality is detected;

changing the first threshold value to a second threshold value larger than the first threshold value when the conveyance of the recording material is temporarily stopped, wherein the second threshold value is referenced from a re-conveyance of the recording material along the conveyance path after the recording material is temporarily stopped; and when the re-conveyance is made to eject the recording material remaining in the conveyance path, detecting a second conveyance abnormality based on the second threshold value.

* * * * *